United States Patent [19]

Bernstrom

[11] Patent Number: 4,976,594

[45] Date of Patent: Dec. 11, 1990

[54] GEROTOR MOTOR AND IMPROVED PRESSURE BALANCING THEREFOR

[75] Inventor: Marvin L. Bernstrom, Eden Prairie, Minn.

[73] Assignee: Eaton Corporation, Cleveland, Ohio

[21] Appl. No.: 380,053

[22] Filed: Jul. 14, 1989

[51] Int. Cl.[5] ..... F03C 2/08; F04C 2/10

[52] U.S. Cl. ..... 418/61.3; 418/77; 418/81; 418/133

[58] Field of Search ..... 418/61.3, 81, 132, 77, 418/133

[56] References Cited

U.S. PATENT DOCUMENTS

| | | | |
|---|---|---|---|
| 1,486,836 | 3/1924 | Hill . | |
| 2,956,512 | 10/1960 | Brundage | 103/216 |
| 3,289,542 | 12/1966 | Fikse | 91/56 |
| 3,490,383 | 1/1970 | Parrett | 418/61.3 |
| 3,512,905 | 5/1970 | Waldorff | 418/61.3 |
| 3,869,228 | 3/1975 | Swedberg | 418/132 |
| 4,715,798 | 12/1987 | Bernstrom | 418/61.3 X |
| 4,717,320 | 1/1988 | White, Jr. | 418/61.3 |
| 4,741,681 | 5/1988 | Bernstrom | 418/61.3 |

*Primary Examiner*—John J. Vrablik
*Attorney, Agent, or Firm*—L. J. Kasper

[57] ABSTRACT

A rotary fluid pressure device is provided of the type including a housing portion (13), a gerotor gear set (15), and an endcap member (17). The gerotor gear set includes an internally-toothed ring member (19) and an externally-toothed star member (23) which orbits and rotates within the ring member. The star includes an end surface (24) disposed adjacent a stationary valve member (65), and another end surface (26) disposed adjacent the shaft housing. The star (23) defines high-pressure ports (93) and low-pressure ports (95) which engage in commutating fluid communication with valve passages (83) defined by the stationary valve member. The star (23) defines passages (101) and (103) which communicate with the fluid ports (93) and (95), respectively, and feed high pressure to a fluid chamber (113) having a transverse area (B). Seated against the stationary valve member (65), and disposed within the endcap (17) is a pair of O-ring seals (117) and (119) which cooperate with adjacent surfaces to define a pressurized region (121) which is in communication with whichever of the ports (37) or (39) is at higher pressure. The region (121) has a transverse area (A), the area (A) being equal to or greater than the area (B). Pressurized fluid in both the fluid chamber (113) and pressurized region (121) biases the star (23) into sealing engagement with the stationary valve plate (65) to prevent cross-port leakage, while at the same time, maintaining a sufficiently small end clearance between the end surface (26) of the star and the adjacent wear surface (111) to substantially eliminate leakage from the volume chambers to the case drain.

14 Claims, 3 Drawing Sheets

GEROTOR MOTOR AND IMPROVED PRESSURE BALANCING THEREFOR

BACKGROUND OF THE DISCLOSURE

The present invention relates to low-speed, high-torque hydraulic devices, and more particularly, to such devices including a gerotor gear set including a stationary ring member and an orbiting and rotating star member.

Low-speed, high-torque gerotor motors are now routinely operated with pressure differentials (i.e., difference between inlet port pressure and outlet port pressure) of 2,000 to 3,000 psi. Some gerotor motors have recently been developed which are capable of operating continuously at pressure differentials even greater than 3,000 psi.

One of the primary causes of reduced volumetric efficiency in gerotor motors is leakage between each of the end surfaces of the gerotor star and the adjacent end surfaces of the housing or stationary valve member. Such leakage is inherent because the fixed ring member must be axially longer than the orbiting and rotating gerotor star, and because the adjacent housing surfaces are substantially parallel to each other, and are clamped to the end surfaces of the gerotor ring, there is an inherent clearance and leakage path along both ends of the gerotor star. Such leakage paths, and the resulting reduced volumetric efficiency, become even more significant as the operating pressure differential across the motor is continually being increased.

SUMMARY OF THE INVENTION

Accordingly, it is an object of the present invention to provide an improved low-speed, high-torque gerotor motor of the type including a fixed ring member and an orbiting and rotating gerotor star, wherein the end clearance along the end surfaces of the gerotor star are substantially eliminated, and the resulting leakage from the volume chambers to the motor case drain is substantially eliminated.

The above and other objects of the present invention are accomplished by the provision of an improved rotary fluid pressure device of the type including housing means defining a fluid inlet port and a fluid outlet port and a rotary fluid displacement mechanism including a ring member having a plurality of internal teeth and a star member defining one axial end surface and another axial end surface, and having a plurality of external teeth The star member is eccentrically disposed within the ring member for orbital and rotational movement therein, and the teeth of the ring member and star member interengage to define expanding and contracting fluid volume chambers in response to the orbital and rotational movement. Valve means cooperates with the housing means to define a main fluid flow path providing fluid communication between the fluid inlet port and the expanding volume chambers and between the contracting volume chambers and the fluid outlet port. The device includes output shaft means, and means operable to transmit torque from the star member to the output shaft means. The valve means includes a stationary valve member disposed adjacent the one axial end surface of the star member, and the housing means defines a wear surface disposed adjacent the other axial end surface of the star member.

The improved device is characterized by at least a portion of the stationary valve member being axially movable toward the one axial end surface of the star member. Another axial end surface of the star member and the wear surface of the housing means cooperate to define a fluid chamber. The device includes means defining a first fluid passage communicating pressurized fluid from the main fluid flow path, upstream of the fluid displacement mechanism, to the fluid chamber to provide a fluid pressure bias of the star member toward the stationary valve member.

DESCRIPTION OF THE PREFERRED EMBODIMENT

Figure 1:
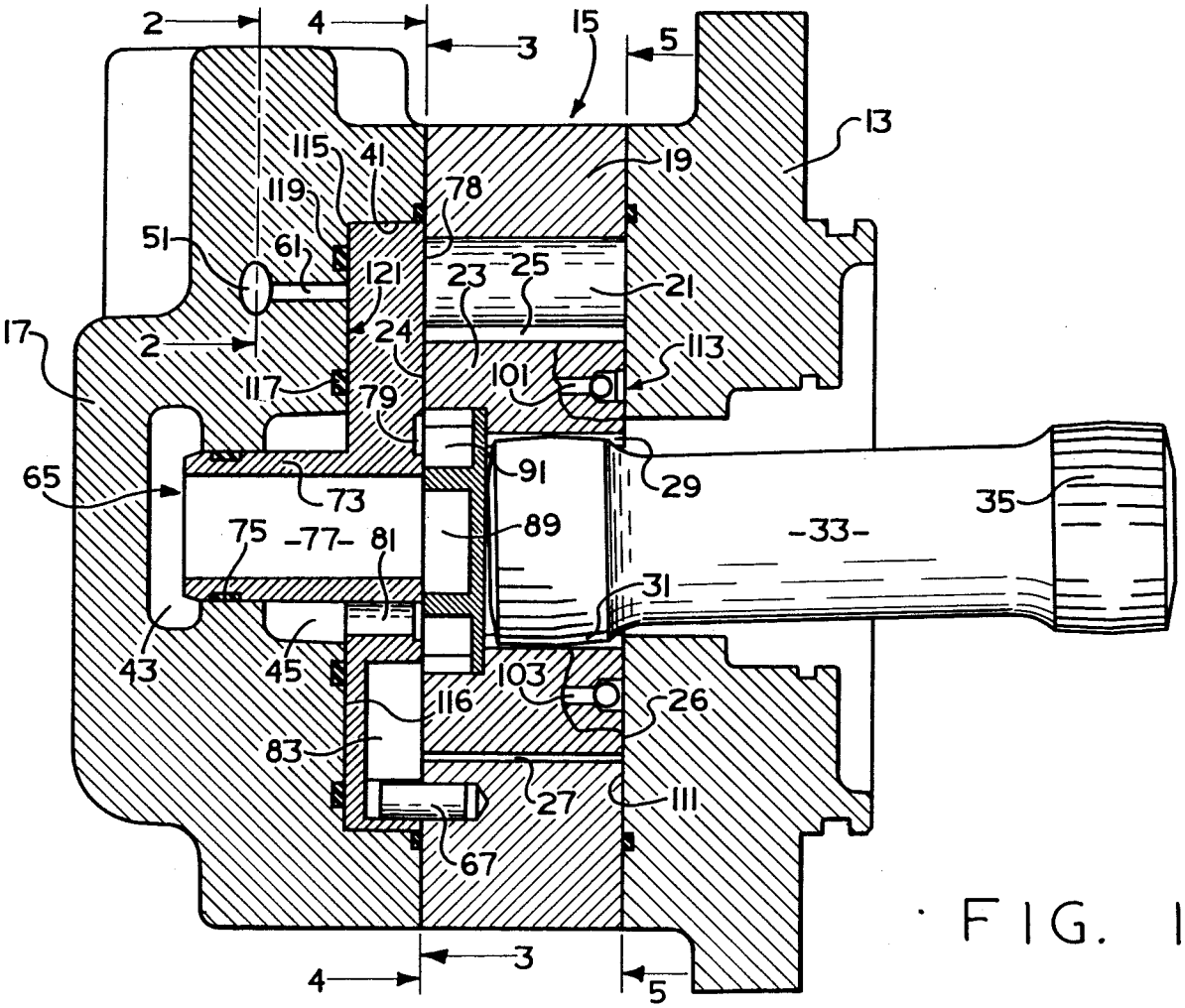
FIG. 1 is an axial cross-section illustrating a low-speed, high-torque gerotor motor made in accordance with the present invention.

Referring now to the drawings, which are not intended to limit the invention, FIG. 1 illustrates a low-speed, high-torque gerotor motor illustrated and described in greater detail in U.S. Pat. No. 4,741,681, assigned to the assignee of the present invention and incorporated herein by reference.

The hydraulic motor shown in FIG. 1 comprises a plurality of sections secured together, such as by a plurality of bolts (not shown). The sections of the motor include a shaft housing portion 13, a gerotor displacement mechanism 15, and an endcap member 17.

The gerotor displacement mechanism 15 is well known in the art, is shown and described in greater detail in above-incorporated 4,741,681, and therefore, will be described only briefly herein. More specifically, the gerotor displacement mechanism 15 is a Geroler$^R$ gear set comprising an internally-toothed ring member 19 defining a plurality of generally semi-cylindrical openings, with a cylindrical roller member 21 disposed in each of the openings, and serving as the internal teeth of the ring member 19. Eccentrically disposed within the ring member 19 is an externally-toothed star member 23, typically having one less external tooth than the number of internal teeth 21, thus permitting the star 23 to orbit and rotate relative to the ring member 19. The orbital and rotational movement of the ring 19 within the star 23 defines a plurality of expanding fluid volume chambers 25, and a plurality of contracting fluid volume chambers 27, as is well known in the art. The star 23 defines a pair of axial end surfaces 24 and 26 (the left end and right end surfaces in FIG. 1, respectively).

Referring still primarily to FIG. 1, the star 23 defines a plurality of straight, internal splines 29, which are in engagement with a set of external, crowned splines 31, formed on one end of a main drive shaft 33. Disposed at the opposite end of the main drive shaft 33 is another set of external, crowned splines 35, adapted to be in engagement with another set of straight, internal splines defined by some form of rotary output, such as a shaft or wheel hub. As is well known to those skilled in the art, gerotor motors of the type to which the present invention relates may include an additional rotary output shaft, supported by suitable bearings. For purposes of the subsequent description, and the appended claims, the main drive shaft 33 may be considered a form of output shaft, and the splines 29 and 31 may be considered the means which transmit torque to the output shaft.

In the subject embodiment, because the star member 23 has eight external teeth (see FIG. 4), the ring member 19 includes nine internal teeth 21, and therefore, eight orbits of the star 23 result in one complete rotation thereof, and one complete rotation of the output end of the drive shaft 33, as is well known in the art.

Figure 2:
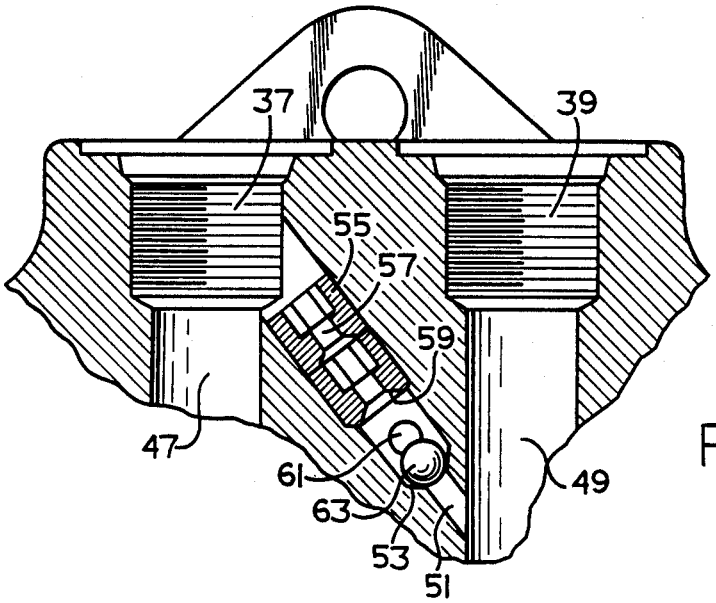
FIG. 2 is a transverse cross-section, through the endcap, taken on line 2—2 of FIG. 1 and on the same scale.

Referring now to FIG. 2, in conjunction with FIG. 1, the endcap member 17 includes a fluid inlet port 37 and a fluid outlet port 39. The endcap member 17 further defines a generally annular recess 41, and a pair of cored fluid pressure chambers 43 and 45. The inlet port 37 communicates with the chamber 43 by means of a bore 47, while the outlet port 39 communicates with the chamber 45 by means of a bore 49.

Referring still to FIGS. 1 and 2, the endcap member 17 defines a drilled, stepped bore 51 communicating between the inlet and outlet ports 37 and 39. The bore 51 includes a conical seat 53, while the enlarged portion of the bore 51 includes a fitting 55 which defines a restricted orifice 57, and another conical seat 59. In communication with the bore 51, at a location disposed between the seats 53 and 59, is an axial bore 61, which extends to the recess 41, for reasons to be described subsequently. Disposed in the bore 51, and movable between the seats 53 and 59 is a shuttle ball 63, which is biased against the seat 53 by the higher pressure in the inlet port 37, that pressure being communicated to the axial bore 61.

Figure 3:
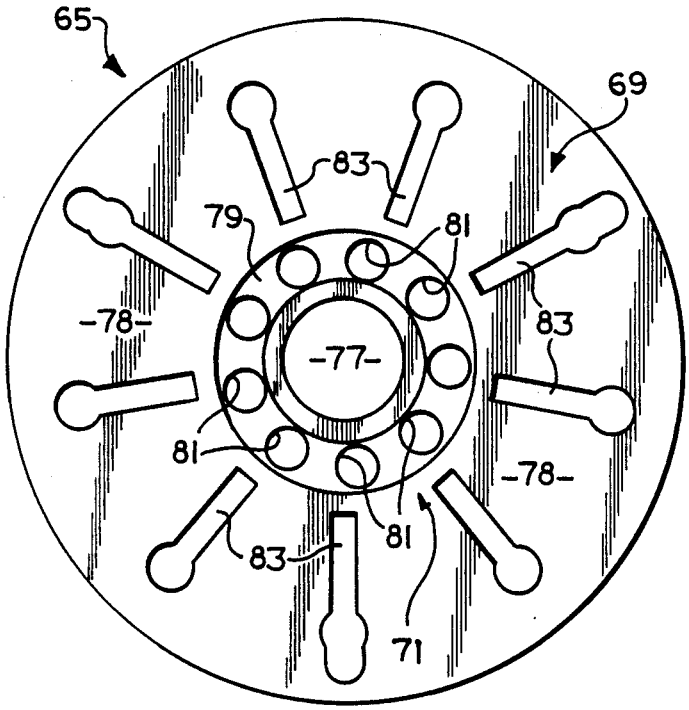
FIG. 3 is a transverse cross-section, showing only the stationary valve plate, taken on line 3—3 of FIG. 1, and on a slightly larger scale.

Referring now to FIG. 3, in conjunction with FIG. 1, disposed in the recess 41 is a stationary valve member 65. The valve member 65 is referred to as "stationary" because it is non-rotatable, i.e., it is fixed relative to the ring member 19 by means of a plurality of pins 67 which are received in blind bores defined by the ring member 19 (see FIG. 1). However, in accordance with one aspect of the present invention, the stationary valve 65 can move axially, or at least have a portion thereof move axially, as will be described in greater detail subsequently.

The stationary valve member 65 comprises a generally plate-like member including a radially-outer peripheral portion 69, which is seated against an axial end surface of the ring member 19. The stationary valve member 65 also includes a radially-inner portion 71 which is disposed adjacent the axial end surface 24 of the star member 23. It should be understood that there is not a precise line of demarcation between the portions 69 and 71, except for being adjacent the ring member 19 and star member 23, respectively. The stationary valve 65 is described as having these separate portions 69 and 71 primarily to facilitate subsequent description of the operation of the invention.

Referring still to FIGS. 1 and 3, the stationary valve member 65 includes a generally cylindrical extension 73 which, as may best be seen in FIG. 1, includes an O-ring seal 75 to prevent fluid leakage between the chambers 43 and 45. The extension 73 defines a cylindrical passage 77 which provides fluid communication between the chamber 43 and the forward surface of the stationary valve 65. The stationary valve 65 includes a forward surface 78 which defines an annular recess 79, and a plurality of axial bores 81 which provide fluid communication from the chamber 45 into the recess 79.

The forward surface 78 of the stationary valve member 65 further defines a plurality of stationary valve passages 83, also referred to in the art as "timing slots". In the subject embodiment, there are nine of the valve passages 83, each of which is disposed in permanent, continuous fluid communication with an adjacent one of the volume chambers 25 or 27. As is well known to those skilled in the art, each volume chamber alternates between being an expanding volume chamber 25 and a contracting volume chamber 27. Preferably, the valve passages 83 are disposed in a generally annular pattern which is concentric relative to the recess 41 and extension 73.

Figure 4:
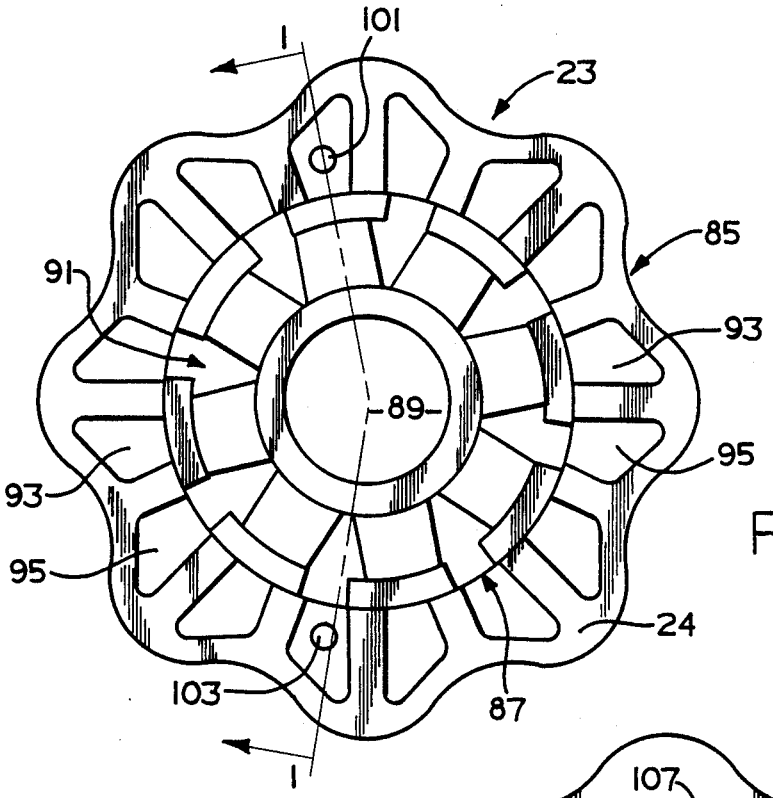
FIG. 4 is a transverse cross-section showing only the gerotor star, taken on line 4—4 of FIG. 1, and on a slightly larger scale.

Referring now primarily to FIG. 4, the star member 23 of the gerotor mechanism 15 will be described in greater detail. In the subject embodiment, the star 23 comprises an assembly of two separate parts, which may be two separate powdered metal (PM) parts, including a main portion 85, which includes the external teeth, and an insert 87. Alternatively, the main portion 85 may be machined, and the insert 87 may be an investment casting.

The star 23 defines a central manifold zone 89, which is in continuous communication with the chamber 43. Concentric with the zone 89 is another manifold zone 91, which is in continuous fluid communication with the annular recess 79, and therefore, with the chamber 45. The end surface 24 of the star 23 defines a group of fluid ports 93, and alternating with the ports 93, a group of fluid ports 95. Each of the fluid ports 93 is in continuous fluid communication with the central manifold zone 89, while each of the fluid ports 95 is in continuous fluid communication with the manifold zone 91. Such communication between the manifold zones and the ports is not an essential feature of the present invention, and is illustrated and described in greater detail in above-incorporated 4,741,681, and will not be described further herein.

As is well known to those skilled in the art, because there are nine volume chambers 25 and 27, there are nine of the stationary valve passages 83, and eight of each of the groups of fluid ports 93 and fluid ports 95. As the star 23 orbits and rotates relative to the ring 19, the groups of fluid ports 93 and 95 engage in a low-speed, commutating valving action with the stationary valve passages 83. The result is that the motor defines a main fluid flow path by which high-pressure fluid flows from the inlet port 37, through bore 47 to the chamber 43, then through the passage 77 into the central manifold zone 89, then through the ports 93 and valve passages 83 to the expanding volume chambers 25. At the same time, low-pressure return fluid is communicated from the contracting volume chambers 27 through certain other stationary valve passages 83 to the ports 95, then from the manifold zone 91 through the recess 79 and bores 81, the chamber 45, the bore 49 and finally to the outlet port 39.

Figure 5:
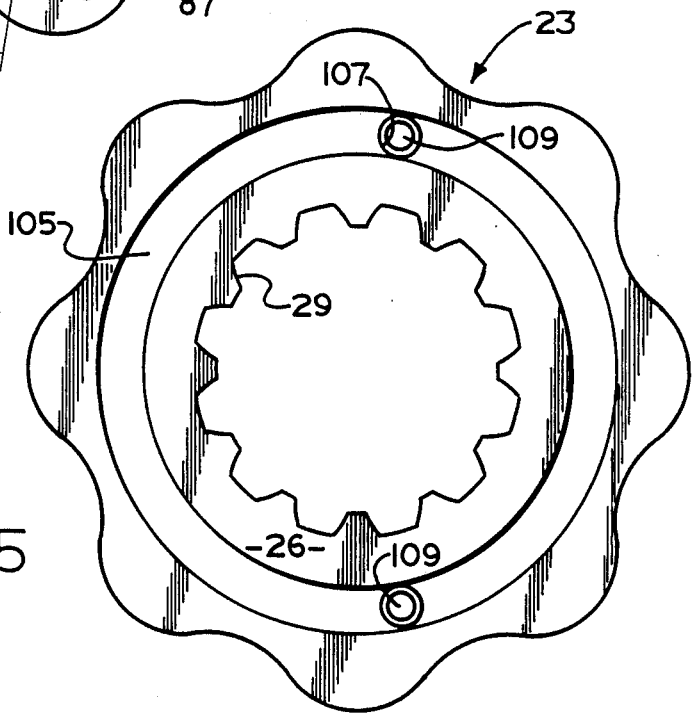
FIG. 5 is a transverse cross-section, showing only the opposite end of the gerotor star, taken on line 5—5 of FIG. 1, and on the same scale as FIG. 4.

Referring now primarily to FIGS. 1, 4 and 5, one aspect of the present invention will be described in some detail. The main portion 85 of the star 23 defines a pair of axial fluid passages 101 and 103. In the subject embodiment, the passage 101 is in communication with one of the fluid ports 93, while the passage 103 is in communication with one of the fluid ports 95. The passages 101 and 103 extend axially from their respective ports toward the other end surface 26 of the star 23, and open into an annular recess 105 defined by the end surface 26. Each axial passage 101 and 103 includes a counterbore 107, which cooperates with its respective passage to define a valve seat, and disposed against the seat within the counterbore 107 is a ball check valve 109. The annular recess 105 cooperates with an adjacent wear surface 111 of the shaft housing portion 13 to define a fluid chamber 113 (see FIG. 1).

The fluid chamber 113 is in continuous fluid communication with the main fluid flow path of the motor, upstream of the expanding volume chambers 25 of the gerotor gear set 15. More specifically, the chamber 113 constantly receives high pressure from whichever of the ports 93 or 95 is at higher fluid pressure, through the respective axial passage 101 or 103. At the same time, communication of the high-pressure fluid from the chamber 113 to whichever of the ports 93 or 95 is at lower pressure is blocked by the seating of the respective ball check valve 109.

The fluid chamber 113 has a transverse area B, which is approximately equal to the transverse area of the recess 105 as shown in FIG. 5. The significance of the area B will be described in greater detail subsequently. During the development of the present invention, it has been found that with the motor operating with a typical inlet pressure of 2,000 or 3,000 psi., the fluid pressure in the chamber 113 tends to bias the star 23 toward the stationary valve member 65, away from the wear surface 111. If the star 23 moves too far from the wear surface 111, there is some leakage of the fluid in the chamber 113 to the case, thus reducing the pressure in the chamber 113, and reducing the clearance between the wear surface 111 and the end surface 26 of the star 23. Furthermore, it has been found possible to regulate the clearance between the wear surface 111 and the end surface 26 by means of the arrangement described above, such that the clearance remains approximately 0.0001 inches, or somewhat less. As will be appreciated by those skilled in the art, a clearance between the end surface 26 of the gerotor and the wear surface 111 which is on the order of 0.0001 inches will result in almost negligible leakage from the pressurized expanding volume chambers 25, along the end surface 26 to the motor case.

Referring again primarily to FIG. 1, the stationary valve member 65 includes a rearward (left end in FIG. 1) transverse surface 115, which is closely spaced apart from an adjacent transverse surface 116 of the endcap 17. The endcap 17 defines a pair of O-ring grooves which, preferably, are concentric relative to each other and approximately concentric relative to the cylindrical extension 73. The grooves receive a radially-inner O-ring 117 and a radially outer O-ring 119. The O-rings 117 and 119 cooperate with the portions of the surfaces 115 and 116 disposed radially therebetween to define a pressurized region 121. The region 121 is in constant fluid communication with whichever of the ports 37 and 39 is at higher pressure, by means of the axial bore 61, as was described previously. The pressurized region 121 has a transverse area A which, in the subject embodiment, is greater than the area B of the fluid chamber 113. Pressurized fluid in the region 121 biases at least a portion of the stationary valve member 65 toward engagement with the adjacent end surface 24, substantially eliminating any leakage clearance between the end surface 24 and the surface 78 of the stationary valve member 65, thus substantially eliminating cross-port leakage from ports 93 or 95 containing high pressure to those containing low pressure.

In the subject embodiment, the radially outer peripheral portion 69 of the stationary valve member 65 is seated against the adjacent end surface of the ring member 19, which is tightly clamped between the shaft housing portion 13 and endcap 17. Thus, fluid pressure in the region 121 does not move the outer portion 69 axially. However, the radially inner portion 71 of the stationary valve member 65 is biased axially by the pressure in the region 121, with the result that the plate-like portion of the valve member 65 bows slightly toward the star 23, and during the development of the present invention, it has been found that the radially inner portion 71 may move axially approximately 0.001 inches, which is enough to maintain tight sealing engagement against the end surface 24 of the star 23.

In the subject embodiment, the star 23 comprises both the orbiting and rotating member of the gerotor gear set 15, as well as the rotary valve member which cooperates with the stationary valve member 65 to provide valving action. However, it should be understood by those skilled in the art that the present invention is not so limited, and can be advantageously utilized in gerotor motors wherein the gerotor star and rotary valve comprise totally separate structural members.

The invention has been described in great detail sufficient to enable one skilled in the art to make and use the same. Obviously, various alterations and modifications of the invention will occur to those skilled in the art upon a reading and understanding of the specification, and it is intended to include all such alterations and modifications as part of the invention, insofar as they come within the scope of the appended claims.

I claim:

1. A rotary fluid pressure device of the type including housing means defining a fluid inlet port and a fluid outlet port; a rotary fluid displacement mechanism including a ring member having a plurality of internal teeth, and a star member defining one axial end surface and another axial end surface and having a plurality of external teeth, said star member being eccentrically disposed within said ring member for orbital and rotational movement therein, the teeth of said ring member and said star member interengaging to define expanding and contracting fluid volume chambers in response to said orbital and rotational movement; valve means cooperating with said housing means to define a main fluid flow path providing fluid communication between said fluid inlet port and said expanding volume chambers and between said contracting volume chambers and said fluid outlet port; output shaft means and means operable to transmit torque from said star member to said output shaft means; said valve means including a stationary valve member comprising a plate-like member disposed to be axially movable relative to said housing means and adjacent said one axial end surface of said star member, said stationary valve member defining a plurality of fluid passages, each of said fluid passages being in fluid communication with one of said fluid volume chambers; and said housing means defining a wear surface disposed adjacent said another axial end surface of said star member; characterized by:

(a) said stationary valve member including a transverse surface disposed oppositely from the surface of said stationary valve adjacent said one axial end surface of said star member, said transverse surface and adjacent surface of said housing means cooperating to define a pressurized region, said housing means defining fluid passage means communicating between said fluid inlet port and said pressurized region, pressurized fluid in said region biasing at least a portion of said stationary valve member toward said star member;

(b) said another end surface of said star member and said wear surface cooperating to define a fluid chamber having an area B; and (c) means defining a first fluid passage communicating pressurized fluid from said main fluid flow path, upstream of said fluid displacement mechanism, to said fluid chamber to provide a fluid pressure bias of said star member toward said stationary valve member.

2. A rotary fluid pressure device as claimed in claim 1 characterized by said fluid chamber comprising a generally annular recess defined by said other end surface of said star member.

3. A rotary fluid pressure device as claimed in claim 1 characterized by said pressurized region having an area A, said area A being at least equal to said area B.

4. A rotary fluid pressure device as claimed in claim 1 characterized by said stationary valve member including a radially-outer peripheral portion and a radially-inner portion, said outer peripheral portion being disposed in engagement with said ring member, whereby pressurized fluid in said pressurized region biases said radially-inner portion axially further than said radially-outer portion toward said star member.

5. A rotary fluid pressure device as claimed in claim 1 characterized by said valve means including a rotary valve member movable in synchronism with said rotational movement of said star member, and defining a plurality of valve ports including a first group of valve ports having constant fluid communication with said fluid inlet port, and a second group of valve ports having constant fluid communication with said fluid outlet port, said first and second groups of valve ports having commutating fluid communication with said fluid passages defined by said stationary valve member in response to rotation of said rotatable valve member.

6. A rotary fluid pressure device as claimed in claim 5 characterized by said rotary valve member comprising a part of said star member, and being disposed in sliding, sealing engagement with said stationary valve member.

7. A rotary fluid pressure device as claimed in claim 6 characterized by said rotary valve member defining a first manifold zone having constant fluid communication with said fluid inlet port and with said first group of valve ports, said rotary valve member and said star member cooperating to define said first fluid passage communicating pressurized fluid from said first manifold zone to said fluid chamber.

8. A rotary fluid pressure device as claimed in claim 7 characterized by said rotary valve member defining a second manifold zone having constant fluid communication with said fluid outlet port and with said second group of valve ports, said rotary valve member and said star member cooperating to define a second fluid passage, communicating between said second manifold zone and said fluid chamber, said rotary fluid pressure device being operable in either direction of rotation of said output shaft means.

9. A rotary fluid pressure device as claimed in claim 7 characterized by each of said first and second fluid passages including check valve means operable to prevent flow of fluid from said fluid chamber to whichever of said first and second manifold zones contains relatively lower fluid pressure.

10. A rotary fluid pressure device of the type including an endcap member defining a fluid inlet port and a fluid outlet port; a rotary fluid displacement mechanism including a ring member having a plurality of internal teeth, and a star member defining one axial end surface and another axial end surface and having a plurality of external teeth, said star member being eccentrically disposed within said ring member for orbital and rotational movement therein, the teeth of said ring member and said star member interengaging to define expanding and contracting fluid volume chambers in response to said orbital and rotational movement; valve means cooperating with said housing means to define a main fluid flow path providing fluid communication between said fluid inlet port and said expanding volume chambers and between said contracting volume chambers and said fluid outlet port; output shaft means and means operable to transmit torque from said star member to said output shaft means; said endcap member including a stationary valve member disposed adjacent said one axial end surface of said star member; said valve means includes a rotary valve member comprising a part of said star member, and being disposed in sliding, sealing engagement with said stationary valve member; said stationary valve member defining a plurality of fluid passages, each of said fluid passages being in fluid communication with one of said fluid volume chambers; said star member defining a plurality of valve ports including a first group of valve ports having constant fluid communication with said fluid inlet port, and a second group of valve ports having constant fluid communication with said fluid outlet port, said first and second groups of valve ports having commutating fluid communication with said fluid passages defined by said stationary valve member in response to rotation of said star member; characterized by:

(a) at least a portion of said stationary valve member being axially movable toward said one axial end surface of said star member; and (b) said stationary valve member including a transverse surface disposed oppositely from the surface of said stationary valve member adjacent said one axial end surface of said star member, said transverse surface and an adjacent surface of said endcap member cooperating to define a pressurized region, said endcap member further defining fluid passage means communicating between said fluid inlet port and said pressurized region, pressurized fluid in said region biasing at least a portion of said stationary valve member toward said star member.

11. A rotary fluid pressure device as claimed in claim 10 characterized by said rotary valve member defining a first manifold zone having constant fluid communication with said fluid inlet port and with said first group of valve ports.

12. A rotary fluid pressure device as claimed in claim 11 characterized by said rotary valve member defining a second manifold zone having constant fluid communication with said fluid outlet port and with said second group of valve ports.

13. A rotary fluid pressure device as claimed in claim 10 characterized by said stationary valve member comprising a plate-like member disposed to be axially movable relative to said endcap member, and disposed axially between said fluid displacement mechanism and said fluid inlet and outlet ports.

14. A rotary fluid pressure device as claimed in claim 10 characterized by said stationary valve member including a radially-outer peripheral portion and radially-inner portion, said outer peripheral portion being disposed in engagement with said ring member, whereby pressurized fluid in said pressurized region biases said radially-inner portion axially further than said radially-outer portion toward said star member.

* * * * *